US006659645B1

(12) United States Patent
Schulz

(10) Patent No.: US 6,659,645 B1
(45) Date of Patent: Dec. 9, 2003

(54) STAND-UP BAG

(75) Inventor: Werner Schulz, Horsens (DK)

(73) Assignee: Amcor Flexibles Europe A/S, Copenhagen (DK)

( * ) Notice: Subject to any disclaimer, the term of this patent is extended or adjusted under 35 U.S.C. 154(b) by 0 days.

(21) Appl. No.: 09/937,084

(22) PCT Filed: Mar. 29, 2000

(86) PCT No.: PCT/DK00/00154

§ 371 (c)(1),
(2), (4) Date: Sep. 21, 2001

(87) PCT Pub. No.: WO00/58174

PCT Pub. Date: Oct. 5, 2000

(30) Foreign Application Priority Data

Mar. 29, 1999 (DK) ..... 1999 00426

(51) Int. Cl.[7] ..... B65D 33/24
(52) U.S. Cl. ..... 383/210; 383/84; 383/104
(58) Field of Search ..... 383/210, 211, 383/104, 122, 84, 200

(56) References Cited

U.S. PATENT DOCUMENTS

| | | | | | |
|---|---|---|---|---|---|
| 2,668,769 | A | * | 2/1954 | Schlienz | 156/202 |
| 2,760,630 | A | * | 8/1956 | Lakso | 206/530 |
| 3,259,303 | A | * | 7/1966 | Repko | 206/497 |
| 3,308,722 | A | * | 3/1967 | Peterson | 383/204 |
| 3,349,993 | A | * | 10/1967 | Ells et al. | 383/203 |
| 3,935,993 | A | | 2/1976 | Doyen et al. | |
| 4,146,133 | A | | 3/1979 | Bogorad et al. | 206/439 |
| 4,385,722 | A | * | 5/1983 | Brewill | 206/554 |
| 5,860,744 | A | * | 1/1999 | Schulz | 383/210 |
| 6,077,551 | A | * | 6/2000 | Scrimager | 383/200 |

FOREIGN PATENT DOCUMENTS

| | | | |
|---|---|---|---|
| DE | 2553853 | 6/1977 | B65B/9/12 |
| EP | 0380110 | 1/1990 | B65D/30/00 |
| WO | WO9316928 | 9/1993 | B65D/30/00 |
| WO | WO9910246 | 3/1999 | B65D/30/00 |

* cited by examiner

*Primary Examiner*—Stephen P. Garbe
(74) *Attorney, Agent, or Firm*—Cooper & Dunham LLP; Donald S. Dowden

(57) ABSTRACT

A stand-up bag of a heat-sealable plastic film comprising two opposing side walls (1, 2) sealed together along the lateral edges thereof by means of side seams (5, 6), an inwardly folded bottom wall (4) provided between the lower portions of the side walls (1, 2) and sealed to the respective side walls (1, 2) along transverse bottom seams (7) and along bottom side seams, and an inwardly folded top wall (3) extending between the side walls and connected to the respective side walls (1, 2) along transverse top connections (11, 12) and sealed to the respective side walls (1, 2) along top side seams. One of the side walls (1) comprises a first side wall section (1*a*) and a second side wall section (1*b*) which overlaps the first side wall section (1*a*) in an overlapping area (15). In the overlapping area (15) the two side wall sections (1*a*, 1*b*) are connected by means of longitudinal peelable connections (19, 20) along the side seams (5, 6) and by means of a transverse peelable connection (18). The second side wall section (1*b*) extends a distance past the transverse peelable connection (18) to form a gripping member (21).

10 Claims, 4 Drawing Sheets

STAND-UP BAG

TECHNICAL FIELD

The invention relates to a stand-up bag of a heat-sealable or weldable plastic film for containing in particular flowable or pourable products and comprising:

- two opposing side walls sealed together along lateral edges thereof by means of side seams;
- an inwardly folded bottom wall extending between the lower portions of the side walls and sealed to the respective side walls along transverse bottom seams and along bottom side seams; and
- an inwardly folded top wall extending between the upper portions of the side walls and connected to the respective side walls along transverse top connections and sealed to the respective side walls along top seams.

BACKGROUND ART

Stand-up bags of this type are known inter alia from U.S. Pat. No. 3,935,993 and DE-A-2553853. Due their excellent standing properties and stability the bags have been used for a wide range of products, in particular for liquid, paste-like, powdery and granular products. It is however considered a drawback of the known stand-up bags that they are difficult to open why a pair of scissors or a knife is often needed or—as for instance known from WO 93/16928 and EP-A-2.0380.110—they are provided with special discharging arrangements for easy removal of the product which makes the bag more expensive.

BRIEF DESCRIPTION OF THE INVENTION

The object of the invention is to provide a stand-up bag of the above type which is easy to open toollessly and which is simple and inexpensive to manufacture.

The stand-up bag according to the invention is characterised in that one side wall comprises a first side wall section and a second side wall section overlapping the first side wall section in a transverse overlapping area between transverse edges of the two side wall sections, that the side wall sections in the overlapping area are connected by means of longitudinal peelable connections along the side seams and by means of a transverse peelable connection, and that the second side wall section extends beyond the transverse peelable connection to form a gripping member. The bag is thus easy to open by gripping and pulling the gripping member, whereby the transverse peelable connection and the longitudinal peelable connections are broken.

According to the invention the bottom seam between the said one side wall and the bottom wall may be provided between the latter and the first side wall section extending from the bottom seam towards the top connection such that its transverse edge is positioned adjacent said top connection, and that the top connection between the said one side wall and the top wall is provided between the latter and the second side wall section situated outermost in the overlapping area. By providing the edge of the first side wall section close to or immediately adjacent the top seam, it is optimised that the packed product remains in the interior of the bag when the bag is opened.

Moreover according to the invention the top connection between the said one side wall and the top wall may be provided between the latter and the first side wall section extending from the top connection a distance downwards towards the bottom seam, and that the bottom seam between said one side wall and the bottom wall may be provided between the latter and the second side wall section situated outermost in the overlapping area and extending from the bottom seam upwards towards the top connection such that the transverse edge thereof is situated adjacent said top connection.

Furthermore according to the invention the gripping member of the second side wall section may be provided with two interspaced incisions in the free edge thereof. It is thereby possible to provide the bag with apertures of several different sizes. When gripping the gripping member between the two incisions, an aperture is formed having a width substantially corresponding to the distance between the incisions, the second side wall section or the flap section being torn along lines extending from the two incisions. By gripping the gripping member in the portion between one of the incisions and the adjacent side seam, an aperture is formed having a width substantially corresponding to the distance between the said incision and the longitudinal peelable connection along the said side seam. It is also possible to form an aperture of a width corresponding to the distance between the two side seams by gripping the gripping member above the two incisions.

Furthermore according to the invention the first side wall section may have an outer sealing medium layer which heat-seals peelably to the inner sealing medium layer of the second side wall section.

In the above embodiment of the invention, the outer sealing medium layer of the first side wall section may be a copolymer comprising polyethylene and polypropylene when the inner sealing medium layer of the bag walls is made from substantially polyethylene. As a result the stand-up bag may be made from a single film web comprising an inner sealing medium layer of substantially polyethylene and an outer sealing medium layer which is a copolymer comprising polyethylene and polypropylene.

In the second last-mentioned embodiment of the invention the outer sealing medium layer of the first side wall section may comprise polypropylene modified to provide a peelable heat seal to polypropylene when the inner sealing medium layer of the bag walls is made from substantially polypropylene. As a result the stand-up bag may be made from a single film web having an inner sealing medium layer substantially being polypropylene and an outer sealing medium layer comprising modified polypropylene to provide a peelable heat seal to polypropylene.

Moreover according to the invention the peelable connections in the overlapping area of the side wall sections may comprise a peelable strip of the hot-melt type applied to at least one of the two mutually facing surfaces of the side wall sections in the overlapping area thereof. Such a hot-melt strip is easy to apply and provides the peelable connections with a peel strength which is easy to control.

Furthermore according to the invention the peelable connections may comprise a film strip arranged in the overlapping area of the two side wall sections and firmly (non-peelably) heat-sealed to one of the two side wall sections, preferably the second side wall section, the strip having a first surface of a sealing medium corresponding substantially to the sealing medium of the adjacent side wall section and heat-sealed peelably to the other side wall section, preferably the first side wall section, the strip having a second surface of a sealing medium heat-sealed peelably to the sealing medium of the adjacent side wall. This embodiment of the invention makes it possible to use plastic films with the same outer and inner sealing medium. When the sealing medium is substantially polyethylene, the first sealing medium surface of the strip is also made from polyethylene, while the second sealing medium surface thereof advantageously may be a copolymer comprising polyethylene and polypropylene. When a plastic film with an outer and an inner sealing medium layers of polypropylene is used for the bag walls, the first surface of the strips is correspondingly made from polypropylene and the other surface thereof is made from modified polypropylene to provide a peelable heat seal to polypropylene.

Moreover according to the invention the peelable connections may comprise a film strip arranged between the two side wall sections in the overlapping area and having a first and a second outer sealing medium layer with which the film strip is firmly (non-peelably) heat-sealed to the respective side wall sections, said film strip further comprising an intermediate layer peelably connected to at least one of the outer sealing medium layers having a tear resistance weaker than the peel strength between the intermediate layer and the said sealing medium layer. The peelable connection is thus opened by tearing the weak sealing medium layer on both sides of the sealing seam and by a delamination between the weak sealing medium layer and the intermediate layer. This embodiment of the invention makes it possible to use plastic films with the same outer and inner sealing medium, which—as mentioned above—may be made from substantially polypropylene or polyethylene. The sealing medium layer of the film strip is also made substantially from polypropylene or polyethylene.

The above embodiment further makes it possible to provide the bag with a degree of reclosability when a pressure-sensitive adhesive, eg. an adhesive of the hot-melt type, is used as the intermediate layer. As the intermediate layer—as mentioned above—is exposed when opening the peelable connections of the bag and the intermediate layer is of a self-sealing adhesive, after the initial opening of the bag said layer is able to adhere to the surface of the opposed side wall section.

Finally according to the invention the peel strength of the peelable connections may be in range from 100 to 800 g/20 mm, preferably from 200 to 600 g/20 mm, and most preferably from 300 to 500 g/20 mm.

BRIEF DESCRIPTION OF THE DRAWINGS

The invention is explained in greater detail below with reference to the accompanying drawings, in which.

BEST MODE FOR CARRYING OUT THE INVENTION

Figure 1:
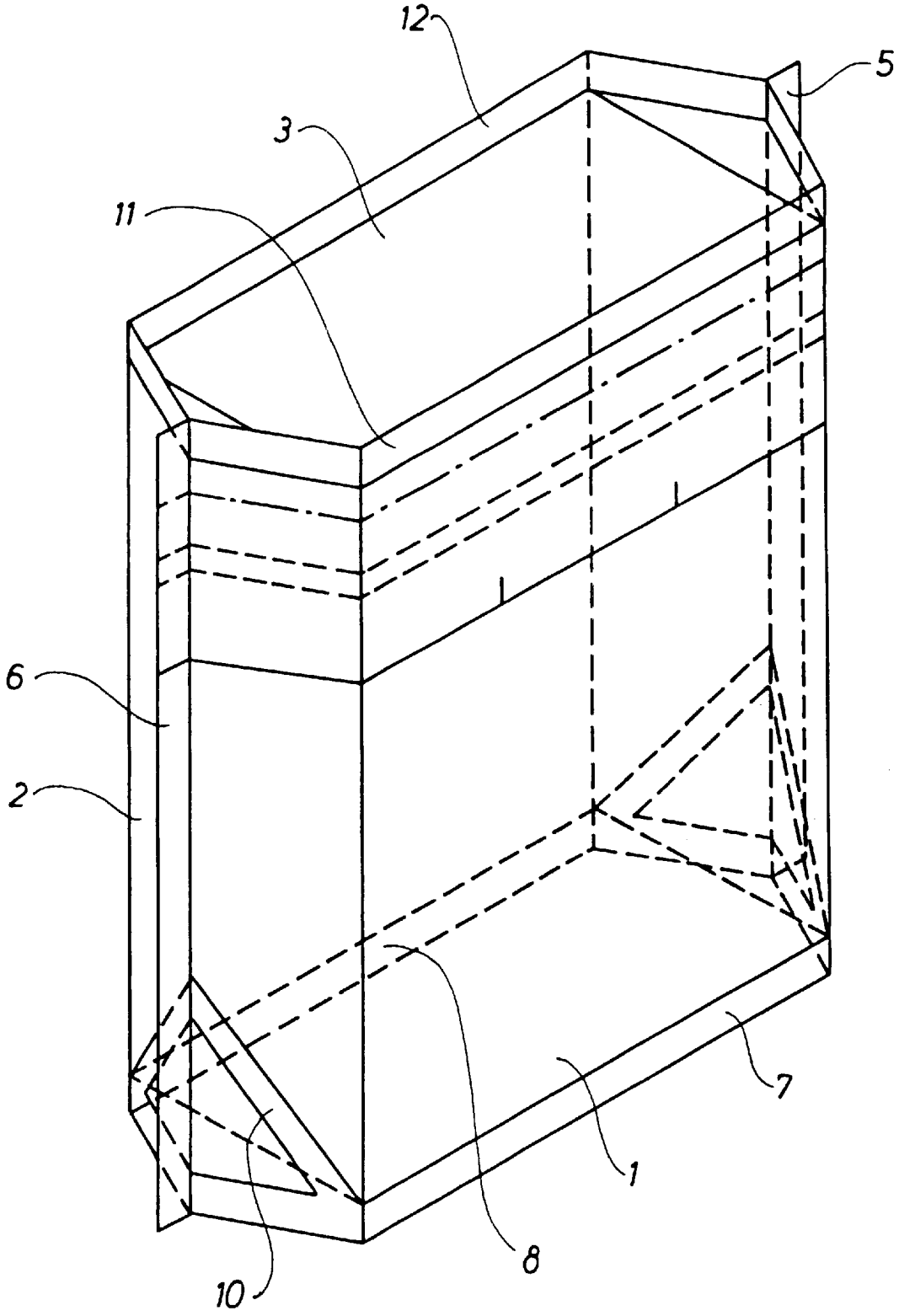
FIG. 1 is an isometric view of a stand-up bag according to the invention.
Figure 2:
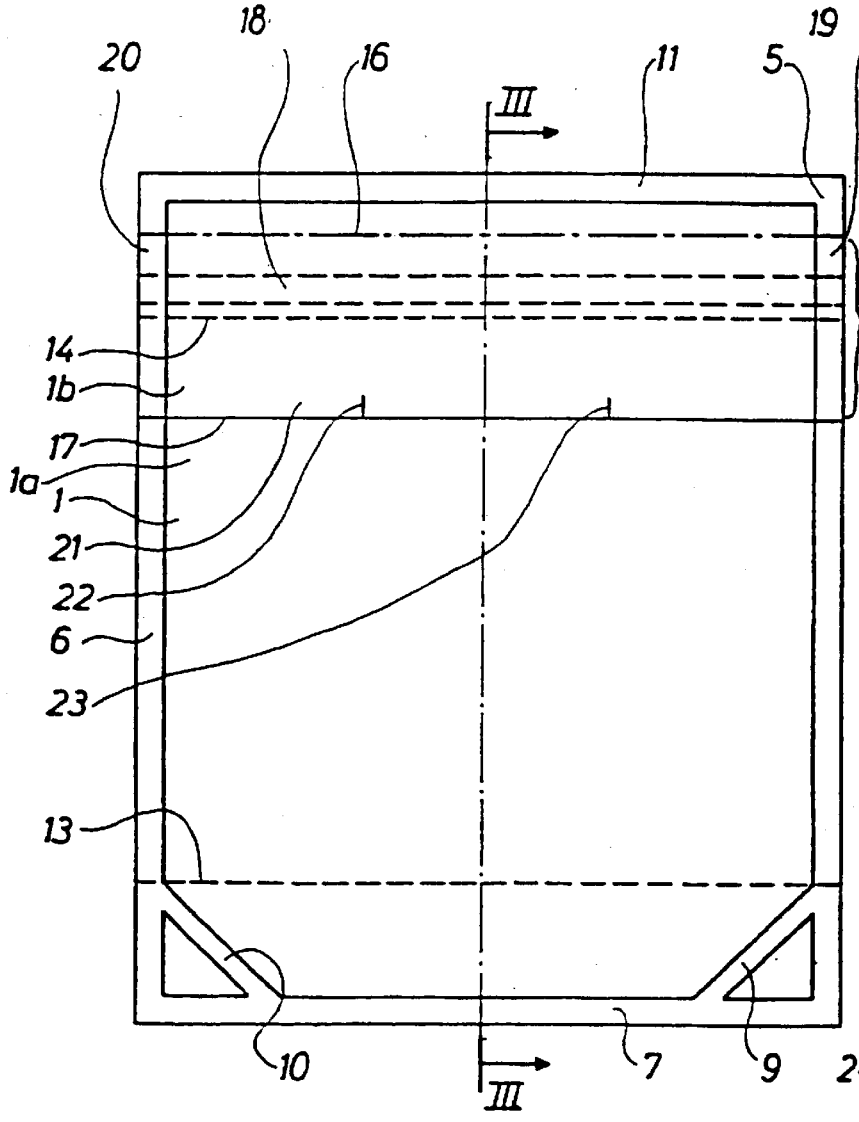
FIG. 2 is a side view of a collapsed stand-up bag according to the invention, FIG. 3. is a sectional view along the line III—III in FIG. 2, the walls of the stand-up bag for purely illustrative reasons being separated from each other and the seals therebetween thus being partially omitted or shown diagrammatically, FIG. 3 further illustrating a first embodiment of the peelable connections between two overlapping side wall section.
Figure 3:
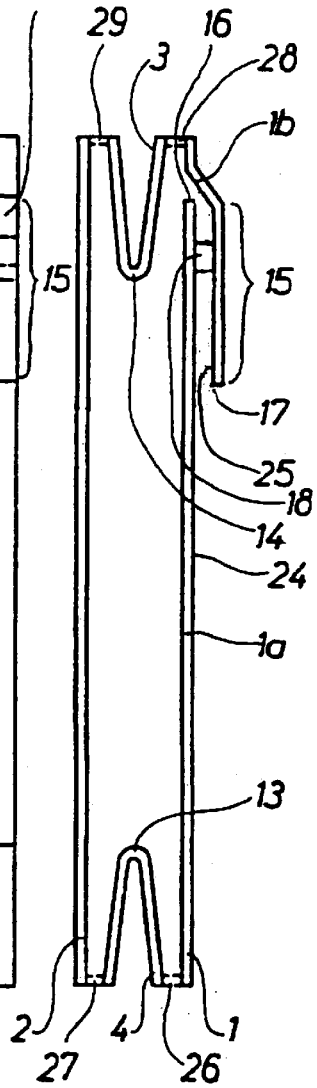
FIG. 3A is a sectional view corresponding to FIG. 3 to illustrate a second embodiment of the peelable connections.

The stand-up bag according to the invention shown in FIGS. 1 to 3 comprises two opposed side walls 1,2 and a top wall 3 and a bottom wall 4 arranged opposite one another. The side walls 1,2 are sealed together by means of side seams 5,6 extending along two opposed side edges. The bottom wall 4 is folded inwardly along a bottom wall fold 13 and sealed to the side walls 1,2 along two opposed lower transverse seals 7.8. Correspondingly the top wall 3 is folded inwardly along a top wall fold 14 and sealed to the side walls 1,2 along two opposed upper transverse seals 11,12. Furthermore both the folded top wall 3 and the folded bottom wall 4 is sealed onto itself and to the side walls along the side seams 5,6. As illustrated the bag may further have oblique seams 9,10, each extending from the fold area of the bottom wall 4 in the respective side seam 5,6 to the adjacent transverse seams 7,8. Each of the oblique seams 9,10 connects a side wall 1,2 to the adjacent area of the bottom wall 4.

As illustrated in FIGS. 1 to 3 the side wall 1 comprises a first lower side wall section 1*a* and a second upper side wall section 1*b* forming a flap and overlapping the first side wall section 1*a* in a transverse overlapping area 15. The overlapping area 15 is defined by the upper edge 16 of the lower side wall section 1*a* and by the lower edge 17 of the flap section. In the overlapping area 15 the flap section 1*b* is connected by heat sealing to the lower side wall section 1*a* by means of a transverse peelable connection 18 and two longitudinal peelable connections 19,20 situated in the area of the side seams 5,6. The transverse peelable connection 18 is spaced from the lower edge 17 of the flap section such that a gripping member 21 is formed therebetween to be gripped when the peelable connections 18, 19, 20 are to be broken for opening of the bag.

At the lowermost free edge 17 of the flap section 1*b* the gripping member 21 is provided with two interspaced incisions 22,23. By gripping the gripping member 21 between the two incisions, the flap 1*b* is torn substantially in line with the two incisions 22,23 and the peelable connection 18 peeled therebetween. An opening is thus provided of a width substantially corresponding to the distance between the two incisions 22,23. By gripping the gripping member between one of the two incisions and the adjacent side seam, eg the incision 23 and the side seam 5 the flap is torn substantially in line with the incision 23, and the peelable connection 19 and the transverse peelable connection 18 between the peelable connection 19 and the incision 23 are also peeled. An opening is thus provided in the bag of a width substantially corresponding to the distance between the incision 23 and the peelable connection 19. Finally, gripping the gripping member above the two incisions 22,23 allows for opening of the flap 1*b* between the two longitudinal peelable connections 19,20 so as to form an opening of a width corresponding substantially to the distance therebetween.

The peelable connections 18, 19, 20 between the inner face of the flap 1*b* and the outer face of the lower side wall section 1*a* are obtained by forming the outer surface 24 (seen in relation to the bag) of the lower side wall section 1*a* of a sealing medium layer which seals peelably by heat sealing to the inner sealing medium layer forming the inner surface 25 of the upper second side wall section or flap 1*b*. When the inner surface 25 of the flap section 1*b* is made from polyethylene, the outer surface 24 of the lower side wall section 1*a* may be formed of a copolymer comprising polyethylene and polypropylene, a peelable connection thereby being obtained by heat sealing. In this connection is should be noted that all of the walls 1,2,3,4 of the bag advantageously may be made from a laminate which seen in relation to the bag has an inner surface made from a sealing medium layer substantially comprising polyethylene and an outer surface made from a sealing medium layer comprising said copolymer of polyethylene and polypropylene.

Even though FIG. 3 illustrates that the side walls 1,2 and the bottom and top walls 4,3 are formed of separate films sealed together, it should be understood that the bag may be formed of a single film web as suggested by means of the dotted lines 26 to 29.

A plurality of different plastic laminates may be used for manufacturing the bag according to the invention. Examples hereof include:

When manufacturing the bag from a single film web a laminate having both an outer and inner sealing medium layer is needed to obtain the peelable connections between the flap section 1*b* of the side wall 1 and the lower side wall section 1*a*. This may be obtained by means of the laminate coex OPP/PETP (polyester)/PE, in which the PE layer is on the inner side seen in relation to the finished bag and coex OPP denotes a co-extruded orientated polypropylene film provided with a thin sealing medium layer on each side comprising a copolymer of OPP and PE. In order to obtain enhanced barrier properties a barrier layer, eg an aluminium film, may be provided between the PETP layer and the PE layer or the coex OPP film. Furthermore the PETP layer may be replaced by an orientated polyamide (OPA).

Another option for manufacturing the bag from a single sheet web is to use a film having an inner sealing medium layer of polypropylene and an outer sealing medium layer of polypropylene which has been modified to provide a peelable connection to the inner polypropylene layer by heat sealing. As mentioned above a PETP film or an OPA film and optionally a barrier layer in form of an aluminium film may also be provided between the inner polypropylene layer and the outer modified polypropylene layer.

To further increase the standing properties and stability of the bag, a stronger or more rigid film may be used for the side walls 1,2 than for the bottom and top walls 3,4. In this case the bag is made from five film webs. The same laminates as mentioned above may be used, thicker laminates being used for the side walls (at least for the lower side wall section 1*a*) than for the bottom and top walls. However a PETP/PE laminate (or PETP/PP laminate) may also be used for the upper side wall section 1*b* and the side wall 2, in which PE facing inwards seen in relation to the bag. A PE/PETP/PE laminate (PP/PETP/PP laminate) or the above coex OPP/PETP/PE laminate (or a modified PP/PETP/PP laminate) may be used for the bottom and top walls. The latter laminate may also be used for the lower side wall 1*a*. Also in this instance the PETP may be replaced by OPA and the laminates may comprise a barrier layer in form of for instance an aluminium film.

It should further be noted that the bag may be formed from a single sheet and from five separate sheets on a vertical form, fill and seal machine. The same applies to the manufacture of pre-fabricated bags, ie finished bags apart from one side seam.

Figure 3A:
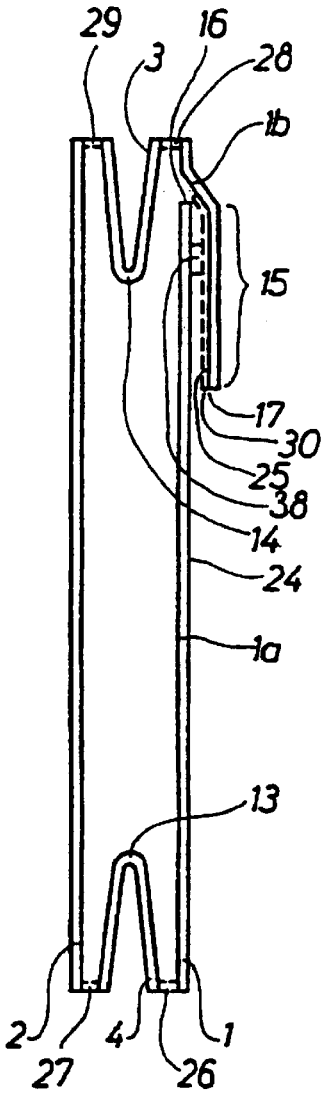

Having described above with reference to FIGS. 1 to 3 a first embodiment of the peelable connections 18, 19, 20 in the overlapping area 15 between the upper side wall section 1*b* and the lower side wall section 1*a* reference is made to FIG. 3A embodiment of the peelable connections between the upper side wall section 1*b* and the lower side section 1*a*, however, only the transverse peelable connection 38 being shown. These peelable connections are formed of a hot-melt strip 30 applied to the inner surface 25 of the upper side wall section 1*b* in the overlapping area between the two side wall sections 1*b* and 1*a*. By activating the hot-melt by means of the sealing tools the peelable connection 38 is formed between the side wall sections 1*a* and 1*b* in the sealing zone 38 in a width corresponding to the width of the sealing tools used. In this embodiment of the peelable connections all of the above laminates may of course be used for the walls. However since the hot-melt strip 30 per se provides the intended peelable connections between the upper side wall section 1*b* and the lower side wall section 1*a*, virtually any laminate or film may be used for the walls provided this has an inner sealing medium layer.

Figure 4:
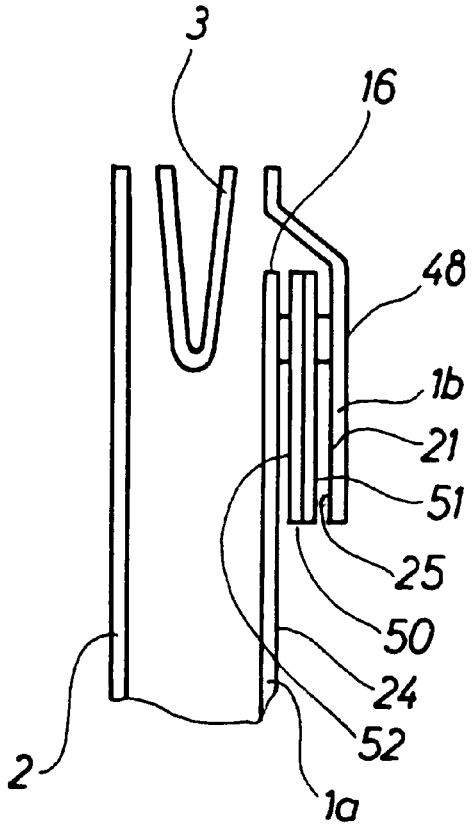
FIG. 4 is a partial sectional view corresponding to FIG. 3 to illustrate a third embodiment of the peelable connections.

FIG. 4 illustrates a third embodiment of the peelable connections between the upper side wall section 1*b* and the lower side wall section 1*a*, however only the transverse peelable connection 48 being shown. The said peelable connections and specifically the transverse peelable connection 48 comprises a film strip 50 provided in the overlapping area 15 of the side wall sections 1*a*, 1*b* and sealed to the upper side wall section 1*b* by means of a strong seal and sealed to the lower side wall section 1*a* by means of a peelable seal. This feature is obtained by the strip 50 comprising a first surface 51 facing the upper side wall section 1*b* and being formed of a sealing medium layer corresponding substantially to the sealing medium layer forming the inner surface 25 of the upper side wall section 1*b* and further comprising a second surface 52 facing the lower side wall section 1*b* and being formed of a sealing medium sealing layer peelably by heat sealing to the sealing medium layer forming the outer surface 24 of the lower side wall section 1*a*. By forming the inner surface 25 of the upper side wall section 1*b* and the outer surface 24 of the lower side wall section 1*a* from substantially PE or PP, the first surface 51 of the film strip 50 may also be formed from substantially PE or PP, while the second surface 52 thereof may be formed from the above-mentioned copolymer comprising PE and PP or the above-mentioned modified PP. When the peelable connections 48 are opened or peeled, the strip 50 remains on the upper side wall section 1*b* and does thus not impede the pouring of the product in the bag, the pouring taking place from the upper transverse edge 16 of the upper side wall section 1*a*.

Figure 5:
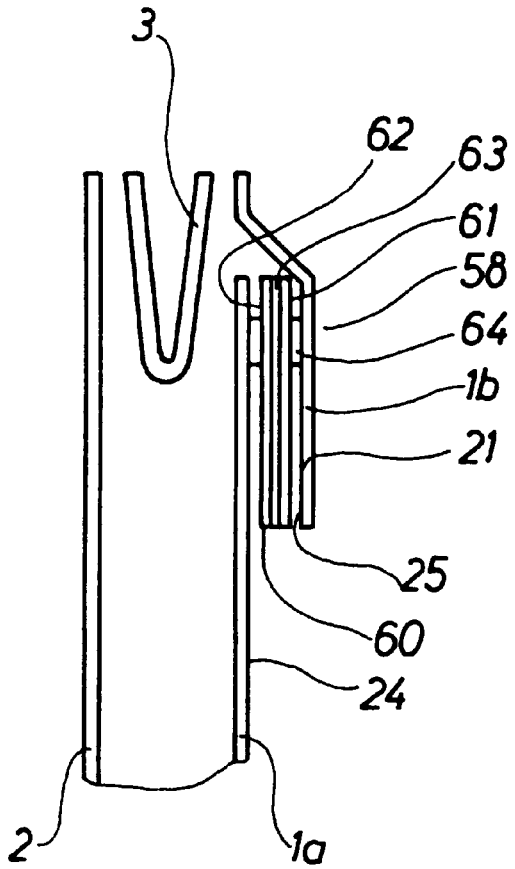
FIG. 5 is a partial sectional view corresponding to FIG. 3 to illustrate a fourth embodiment of the peelable connections.

FIG. 5 illustrates a fourth embodiment of the peelable connections in the overlapping area between the upper side wall section 1*b* and the lower side wall section 1*a*. These peelable connections, of which only the transverse peelable connection 58 appear from FIG. 5, comprise a film strip 60 arranged in the overlapping area 15 and having a first surface layer 61 and a second surface layer 62 of a sealing medium corresponding to the sealing medium forming the inner surface 25 of the upper side wall section 1*b* and the sealing medium layer forming the outer surface 24 of the lower side wall section 1*a*, said film strip thus being heat-sealed non-peelably to the said surfaces. An intermediate layer 63 is provided between the two surface layers 61 and 62 being connected peelably to the second surface layer 62 and preferably more firmly connected to the first surface layer 61. The tear resistance of the second surface layer 62 is further weaker than the peel strength between said layer and the intermediate layer 63. By pulling in the gripping member 21 to open the peelable connections 58, the layer 62 is torn along the edges of the seams 64 corresponding to the edges of the sealing tools used. Furthermore a delamination takes place between the layer 62 and the intermediate layer 63 corresponding to the sealing zones. The use of an intermediate layer 63 of a pressure-sensitive adhesive allow for reclosure of the peelable connection and thus the bag after the initial opening thereof by pressing the exposed portion of the intermediate layer 63 against the corresponding portion of the lower side wall section 1*a*.

Figure 6:
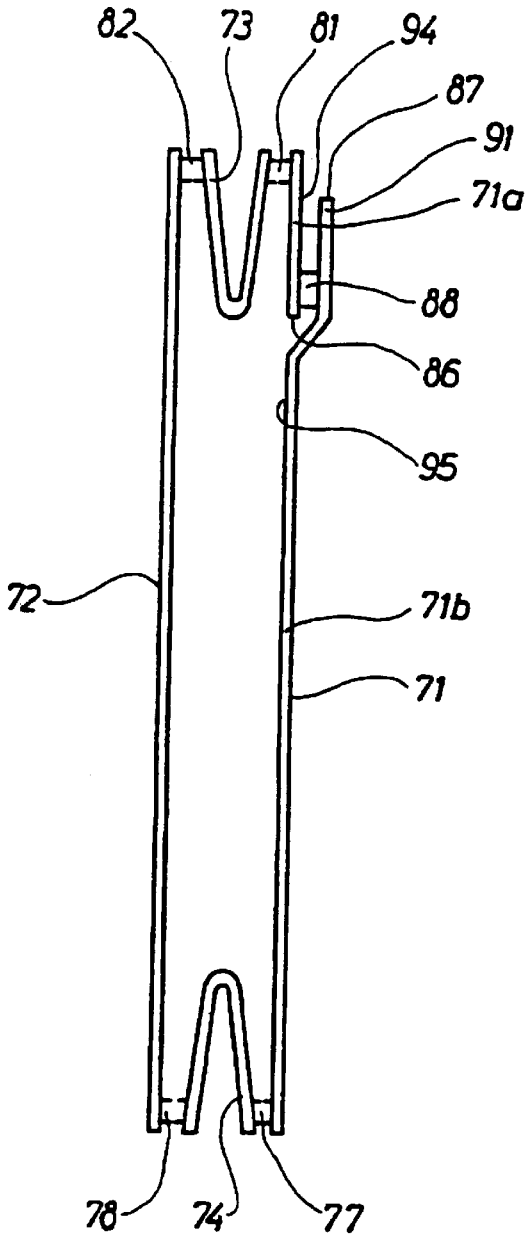
FIG. 6 is an illustration corresponding to FIG. 3 of an alternative embodiment of a stand-up bag according to the invention.

FIG. 6 illustrates an alternative embodiment of the stand-up bag according to the invention corresponding to large extent to the bag described with reference to FIGS. 1 and 3 and thus comprising two opposed side walls 71, 72 and opposed top and bottom walls 73,74. The side walls 71, 72 are sealed together by means of side seams (not shown) corresponding to the side seams 5,6 in FIGS. 1 to 3. The bottom wall 74 is folded inwardly along a bottom wall fold 83 and sealed to the side walls 71,72 along two opposed lower transverse bottom seams 77,78. Correspondingly the top wall 73 is folded inwardly along a top wall fold 84 and sealed to the side walls 71,72 along two opposed upper transverse top seams 81,82. Both the folded top wall 73 and the folded bottom is sealed onto itself and to the side walls along the side seams. As the bag shown in FIGS. 1 to 3, this bag may be provided with oblique seams corresponding to the seams 9,10.

The alternative embodiment of the stand-up bag shown in FIG. 6 differs from the stand-up bag shown in FIGS. 1 to 3 by the structure of the side wall 71. This side wall 71 comprises a first upper side wall section 71*a* and a second lower side wall section 71*b* overlapping the first side wall section 71*a* in a transverse overlapping area 85. The first side wall section 71*a* is sealed to the upper top wall 73 by means of the transverse top seam 81 and extends a short distance downwards from the top seam 81. The first side wall section 71*a* ends in a lower transverse edge 86. The second side wall section 71*b* is sealed to the bottom wall 74 by means of the transverse bottom seam 77 and extends upward therefrom. The second side wall section 71*b* ends in an upper transverse edge 87 below the transverse top seam 81. The overlapping area 85 is defined by the upper edge 87 of the lower side wall section 71*b* and lower edge 86 of the upper side wall section 71*a*. In the overlapping area 85 the second side wall section 71*b* is connected by heat sealing to the first side wall section 71*a* by means of a transverse peelable connection 88 and two longitudinal connections (not shown) situated in the area adjacent the side seams (not shown). The transverse peelable connection 88 is spaced from the upper edge 87 of the second side wall section 71*b* to provide a gripping member 91 therebetween to be gripped when the peelable connections 88 are to be broken for opening of the bag.

The peelable connections 88 between inner face of the second side wall section 71*b* and the outer face of the first side wall section 71*a* is provided by forming the outer surface 94 (seen in relation to the bag) of the first side wall section 71*a* from a sealing medium layer sealing peelably by heat-sealing to the inner sealing medium layer of the second side wall section 71*b*, said sealing medium layer forming the inner surface 95 thereof. By forming the inner surface 95 of the side wall section 71*b* substantially from polyethylene, the outer surface 71*a* of the side wall section 71*a* may be formed from a copolymer comprising polyethylene and polypropylene or from a mixture comprising polyethylene and polybutylene so that a peelable connection is obtained by heat-sealing. Correspondingly by forming the inner sealing medium layer of the side wall section 71*b* substantially from polypropylene, the outer sealing medium layer of the side wall section 71*a* may be polypropylene modified to provide a peelable connection with polypropylene by heat sealing.

The side wall sections 71*a* and 71*b* and the other walls 72,73,74 may thus be formed from the above-mentioned coex OPP/PETP/PE laminate or the modified PP/PETP/PP laminate. As regards possible materials for the walls of the bag, reference is made to the mention in the description of the embodiment shown in FIGS. 1 to 3 of the bag and of the embodiment of the peelable connections between the two side wall sections shown in FIGS. 3 to 5. It is thus to be understood that also in the embodiment shown in FIG. 6 of the stand-up bag the embodiments of the peelable connections shown in FIGS. 3 to 5 may be used.

What is claimed is:

1. Stand-up bag of a heat-sealable or weldable plastic film for containing in particular flowable or pourable products and comprising:

two opposing side walls (1, 2; 71, 72) sealed together along lateral edges thereof by means of side seams (5, 6);

an inwardly folded bottom wall (4;74) provided between the lower portions of the side walls (1, 2; 71, 72) and sealed to the respective side walls (1, 2; 71, 72) along transverse bottom seams (7, 8; 77, 78) and along bottom side seams, and an inwardly folded top wall extending between the upper portions of the side walls (1, 2; 71, 72) and connected to the respective side walls along transverse top connections (11, 12; 81, 82) and sealed to the respective side walls (1, 2; 71, 72) along top side seams, characterised in that one side wall (1; 71) comprises a first side wall section (1*a*; 71*a*) and a second side wall section (1*b*; 71*b*) overlapping the first side wall section (1*a*; 71*a*) in a transverse overlapping area (15; 85) between transverse edges (16, 17; 86, 87) of the two side wall sections (1*a*, 1*b*; 71*a*, 71*b*), that the side wall sections (1*a*, 1*b*; 71*a*, 71*b*) in the overlapping area (15; 85) are connected by means of longitudinal peelable connections (19, 20) and by means of a transverse peelable connection (18; 38; 48; 58; 88), and that the second side wall section (1*b*; 71*b*) extends beyond the transverse peelable connection (18; 38; 48; 58; 88) to form a gripping member (21; 91).

2. Stand-up bag according to claim 1, characterised in that the bottom seam (7) is provided between the bottom wall and the first side wall section (1*a*), and that the top connection (11) is provided between the top wall and the second side wall section (1*b*) situated outermost in the overlapping area (15).

3. Stand-up bag according to claim 1, characterised in that the top connection (81) is provided between the top wall and the first side wall section (71*a*), and that the bottom seam (77) is provided between the bottom wall and the second side wall section (71*b*) situated outermost in the overlapping area (85).

4. Stand-up bag of a heat-sealable or weldable plastic film for containing in particular flowable or pourable products and comprising:

two opposing side walls (1, 2; 71, 72) sealed together along lateral edges thereof by means of side seams (5, 6);

an inwardly folded bottom wall (4;74) provided between the lower portions of the side walls (1, 2; 71, 72) and sealed to the respective side walls (1, 2; 71, 72) along transverse bottom seams (7, 8; 77, 78) and along bottom side seams, and an inwardly folded top wall extending between the upper portions of the side walls (1, 2; 71, 72) and connected to the respective side walls along transverse top connections (11, 12; 81, 82) and sealed to the respective side walls (1, 2; 71, 72) along top side seams, characterised in that one side wall (1; 71) comprises a first side wall section (1*a*; 71*a*) and a second side wall section (1*b*; 71*b*) overlapping the first side wall section (1*a*; 71*a*) in a transverse overlapping area (15; 85) between transverse edges (16, 17; 86, 87) of the two side wall sections (1*a*, 1*b*; 71*a*, 71*b*), that the side wall sections (1*a*, 1*b*; 71*a*, 71*b*) in the overlapping area (15; 85) are connected by means of longitudinal peelable connections (19, 20; 39, 40) and by means of a transverse peelable connection (18; 38; 48; 58; 88), and that the second side wall section (1*b*; 71*b*) extends beyond the transverse peelable connection (18; 38; 48; 58; 88) to form a gripping member (21; 91) and further characterised in that the gripping member (21) of the second side wall section (1*b*) is provided with two interspaced incisions (22,23) in the free edge (17) thereof.

5. Stand-up bag according to claim 1, characterised in that the first side wall section (1*a*; 71*a*) has an outer sealing medium layer (24; 94) which heat-seals peelably to an inner sealing medium layer (25; 95) of the second side wall section (1*b*;71*b*).

6. Stand-up bag according to claim 5, and wherein the inner sealing medium layer of the bag walls is made substantially from polyethylene (PE), characterised in that an outer sealing medium layer (24;94) of the first side wall section (1*a*; 71*a*) is made from a copolymer comprising polyethylene (PE) and polypropylene (PP).

7. Stand-up bag according to claim 5, and wherein the inner sealing medium layer of the bag walls is made substantially from polypropylene (PP), characterised in that the outer sealing medium layer (24;94) of the first side wall section (1*a*;7*a*) comprises modified polypropylene which is modified to provide a peelable connection with polypropylene by heat sealing.

8. Stand-up bag of a heat-sealable or weldable plastic film for containing in particular flowable or pourable products and comprising:

two opposing side walls (1, 2; 71, 72) sealed together along lateral edges thereof by means of side seams (5, 6);

an inwardly folded bottom wall (4;74) provided between the lower portions of the side walls (1, 2; 71, 72) and sealed to the respective side walls (1, 2; 71, 72) along transverse bottom seams (7, 8; 77, 78) and along bottom side seams, and an inwardly folded top wall extending between the upper portions of the side walls (1, 2; 71, 72) and connected to the respective side walls along transverse top connections (11, 12; 81, 82) and sealed to the respective side walls (1, 2; 71, 72) along top side seams, characterised in that one side wall (1; 71) comprises a first side wall section (1*a*; 71*a*) and a second side wall section (1*b*; 71*b*) overlapping the first side wall section (1*a*; 71*a*) in a transverse overlapping area (15; 85) between transverse edges (16, 17; 86, 87) of the two side wall sections (1*a*, 1*b*; 71*a*, 71*b*), that the side wall sections (1*a*, 1*b*; 71*a*, 71*b*) in the overlapping area (15; 85) are connected by means of longitudinal peelable connections (19, 20; 39, 40) and by means of a transverse peelable connection (18; 38; 48; 58; 88), and that the second side wall section (1*b*; 71*b*) extends beyond the transverse peelable connection (18; 38; 48; 58; 88) to form a gripping member (21; 91)

and further characterised in that the peelable connections in the overlapping area (15) of the side wall sections (1*a*, 1*b*) comprise a peelable strip (30) of the hot-melt type applied to at least one of the two mutually facing surfaces (24,25) of the side wall sections (1*a*, 1*b*) in the overlapping area (15) thereof.

9. Stand-up bag of a heat-sealable or weldable plastic film for containing in particular flowable or pourable products and comprising:

two opposing side walls (1, 2; 71, 72) sealed together along lateral edges thereof by means of side seams (5, 6);

an inwardly folded bottom wall (4;74) provided between the lower portions of the side walls (1, 2; 71, 72) and sealed to the respective side walls (1, 2; 71, 72) along transverse bottom seams (7, 8; 77, 78) and along bottom side seams, and an inwardly folded top wall extending between the upper portions of the side walls (1, 2; 71, 72) and connected to the respective side walls along transverse top connections (11, 12; 81, 82) and sealed to the respective side walls (1, 2; 71, 72) along top side seams, characterised in that one side wall (1; 71) comprises a first side wall section (1*a*; 71*a*) and a second side wall section (1*b*; 71*b*) overlapping the first side wall section (1*a*; 71*a*) in a transverse overlapping area (15; 85) between transverse edges (16, 17; 86, 87) of the two side wall sections (1*a*, 1*b*; 71*a*, 71*b*), that the side wall sections (1*a*, 1*b*; 71*a*, 71*b*) in the overlapping area (15; 85) are connected by means of longitudinal peelable connections (19, 20; 39, 40) and by means of a transverse peelable connection (18; 38; 48; 58; 88), and that the second side wall section (1*b*; 71*b*) extends beyond the transverse peelable connection (18; 38; 48; 58; 88) to form a gripping member (21; 91)

and further characterised in that the peelable connections (48) comprise a film strip (50) arranged in the overlapping area of the two side wall sections (1*a*, 1*b*) and firmly heat-sealed to one of the two side wall sections, the strip (50) having a first surface (51) of a sealing medium corresponding substantially to the sealing medium of the adjacent side wall section and heat-sealing peelably to the other side wall section, the first side wall section (1*a*), the strip (50) having a second surface (52) of a sealing medium heat-sealing peelably to the sealing medium of the adjacent side wall.

10. Stand-up bag of a heat-sealable or weldable plastic film for containing in particular flowable or pourable products and comprising:

two opposing side walls (1, 2; 71, 72) sealed together along lateral edges thereof by means of side seams (5, 6);

an inwardly folded bottom wall (4;74) provided between the lower portions of the side walls (1, 2; 71, 72) and sealed to the respective side walls (1, 2; 71, 72) along transverse bottom seams (7, 8; 77, 78) and along bottom side seams, and an inwardly folded top wall extending between the upper portions of the side walls (1, 2; 71, 72) and connected to the respective side walls along transverse top connections (11, 12; 81, 82) and sealed to the respective side walls (1, 2; 71, 72) along top side seams, characterised in that one side wall (1; 71) comprises a first side wall section (1*a*; 71*a*) and a second side wall section (1*b*; 71*b*) overlapping the first side wall section (1*a*; 71*a*) in a transverse overlapping area (15; 85) between transverse edges (16, 17; 86, 87) of the two side wall sections (1*a*, 1*b*; 71*a*, 71*b*), that the side wall sections (1*a*, 1*b*; 71*a*, 71*b*) in the overlapping area (15; 85) are connected by means of longitudinal peelable connections (19, 20; 39, 40) and by means of a transverse peelable connection (18; 38; 48; 58; 88), and that the second side wall section (1*b*; 71*b*) extends beyond the transverse peelable connection (18; 38; 48; 58; 88) to form a gripping member (21; 91)

and further characterised in that the peelable connections (58) comprise a film strip (60) arranged between the two side wall sections (1*a*, 1*b*) in the overlapping area and having a first and a second outer sealing medium layer (61,62) with which the film strip (60) is firmly heat-sealed to the respective side wall sections (1*a*, 1*b*), said film strip further comprising an intermediate layer (63) peelably connected to at least one of the outer sealing medium layers (62) having a tear resistance weaker than the peel strength between the intermediate layer (63) and the said sealing medium layer (62).

* * * * *